US005310129A

United States Patent [19]

Whittington et al.

[11] Patent Number: 5,310,129

[45] Date of Patent: May 10, 1994

[54] SYSTEM FOR SEQUENTIALLY DISPENSING WEB MATERIAL FROM A PLURALITY OF ROLLS

[75] Inventors: Jimmie L. Whittington, Diamond Bar; Patrick C. Perrin, Rancho Palos Verdes, both of Calif.

[73] Assignee: James River Paper Company, Inc., Richmond, Va.

[21] Appl. No.: 61,588

[22] Filed: May 17, 1993

[51] Int. Cl.[5] ..... B65H 19/10

[52] U.S. Cl. ..... 242/55.3; 242/55.53

[58] Field of Search ..... 312/34.22, 34.24, 34.8; 242/55.3, 55.42, 55.53

[56] References Cited

U.S. PATENT DOCUMENTS

| | | | |
|---|---|---|---|
| 3,294,329 | 12/1966 | Tucker et al. | 242/55.3 |
| 3,650,487 | 3/1972 | Bashnsen | 242/55.3 |
| 3,698,653 | 10/1972 | Okamura | 242/55.3 |
| 3,770,222 | 11/1973 | Jespersen | 242/55.3 |
| 4,108,389 | 8/1973 | Womack | 242/55.3 |
| 4,108,513 | 8/1978 | Lander | 312/39 |
| 4,222,621 | 9/1980 | Greenlee et al. | 242/55.3 |
| 4,362,278 | 12/1982 | Hopkinson | 242/55.3 |
| 4,383,657 | 5/1983 | Suh | 242/55.3 |
| 4,557,426 | 12/1985 | Siciliano | 242/55.3 |
| 4,564,148 | 1/1986 | Wentworth | 242/55.3 |

*Primary Examiner*—Daniel P. Stodola
*Assistant Examiner*—John Q. Nguyen
*Attorney, Agent, or Firm*—Thomas R. Lampe

[57] ABSTRACT

Apparatus for sequentially dispensing web material from a plurality of rolls of the webbed material. The apparatus includes a support having a housing with an opening. A roll holder is rotatably mounted on the support. The roll holder includes at least three spaced roll support shafts which are inserted into rolls. The roll holder and rolls are maintained in an unbalanced condition to sequentially present the rolls at a dispensing position under the influence of gravity.

4 Claims, 5 Drawing Sheets

SYSTEM FOR SEQUENTIALLY DISPENSING WEB MATERIAL FROM A PLURALITY OF ROLLS

TECHNICAL FIELD

This invention relates to an apparatus and a method for sequentially dispensing web material from a plurality of rolls of said web material. The invention has particular application to the dispensing of paper from paper rolls, such as rolls of toilet tissue.

BACKGROUND ART

Many dispenser systems are known in the prior art for sequentially or serially dispensing paper or other web materials from a plurality of rolls thereof. Many such arrangements incorporate mechanisms which are responsive to depletion of one roll to present another at dispensing position. The following United States patents are believed representative of such arrangements: U.S. Pat. No. 3,294,329, issued Dec. 27, 1966, U.S. Pat. No. 4,108,389, issued Aug. 22, 1978, U.S. Pat. No. 3,650,487, issued Mar. 21, 1972, U.S. Pat. No. 4,564,148, issued Jan. 14, 1986, U.S. Pat. No. 4,383,657, issued May 17, 1983, U.S. Pat. No. 4,362,278, issued Dec. 7, 1982, U.S. Pat. No. 4,222,621, issued Sep. 16, 1980, U.S. Pat. No. 3,770,222, issued Nov. 6, 1973, and U.S. Pat. No. 3,698,653, issued Oct. 17, 1972.

U.S. Pat. No. 3,294,329 is of particular interest since it employs a mechanism wherein two rolls of toilet tissue or the like are mounted on spindles which move relative to one another to alternatively present one or the other of the rolls in dispensing position. Depletion of one of the rolls results in a pivoting action of the roll support mechanism causing relative movement between the spindles to move the reserve roll to dispensing position.

U.S. Pat. No. 4,457,426, issued Dec. 10, 1985, and U.S. Pat. No. 4,108,513, issued Aug. 22, 1978, are worthy of comment in that they disclose rotary support members carrying a plurality of toilet paper rolls which are sequentially presented to a user. In both of the arrangements, however, advancement of a full roll to replace one that has been depleted is accomplished manually by a user effecting rotation of the rotary support member by hand.

DISCLOSURE OF INVENTION

The present invention relates to a system for sequentially dispensing web material from a plurality of rolls which is characterized by its relative simplicity and low cost as compared to many existing types of multi-roll dispenser systems employing mechanisms for automatically advancing a roll. With the arrangement of the present invention, advancement of full rolls sequentially to a dispensing position is effected automatically, without any effort on the part of the user, such action occurring under the influence of gravity.

In contrast to the arrangement disclosed in U.S. Pat. No. 3,294,329, the apparatus of the present invention is operative to sequentially present more than two rolls. Furthermore, the dispensing position assumed by the rolls sequentially presented for dispensing by the present invention is a single position, as compared with the arrangement in U.S. Pat. No. 3,294,329 wherein the rolls are essentially disposed side-by-side with different dispensing positions for each roll. Also, the apparatus of the present invention is relatively simple in construction and operation.

The apparatus of the present invention is for sequentially dispensing web material from a plurality of rolls of web material. The apparatus incorporates a support including a housing having an opening.

Roll holder means is movably mounted on the support for rotation about an axis of rotation, the roll holder means including at least three spaced roll support shafts. Each support shaft is for insertion into a roll for supporting a roll.

Rotation of the roll holder means serially presents the support shafts at the opening. Rotation of the roll holder means is interrupted when a support shaft holding a roll is presented at the opening until the roll held thereby is substantially depleted. The roll holder means rotates in response to substantial depletion of a roll on the shaft at the opening to present another support shaft holding a roll at the opening.

The support shafts are so positioned relative to each other and relative to the axis of rotation as to create an unbalanced condition of the roll holder means and any rolls on the support shafts. This arrangement exerts a biasing force on the roll holder means causing rotation of the roll holder means under the influence of gravity until all rolls on the support shafts are substantially depleted.

The apparatus additionally comprises lock means operatively associated with the support and the roll holder means for locking the roll holder means against further rotation about the axis of rotation after interruption of roll holder means rotation. The lock means is responsive to substantial depletion of a roll at the opening to unlock the roll holder means and allow the roll holder means to rotate under the influence of gravity.

The method of the present invention is for sequentially dispensing web material from a plurality of rolls of said web material.

The method includes the step of mounting at least three rolls of web material on a rotatable support at spaced locations on the support.

According to the method, an unbalanced condition is created with the mounted rolls whereby the rotatable support will rotate under the influence of gravity to deliver a first mounted roll to a predetermined dispensing position.

Rotational movement of the rotatable support and rolls mounted thereon is interrupted when the first mounted roll reaches the predetermined dispensing position.

The first roll is then substantially depleted at the predetermined dispensing position by unwinding the first roll.

Rotation of the rotatable support and rolls mounted thereon is continued under the influence of gravity responsive to the substantial depletion of the first roll until a second roll reaches the predetermined position.

Other features, advantages, and objects of the present invention will become apparent with reference to the following description and accompanying drawings.

BEST MODE FOR CARRYING OUT THE INVENTION

Figure 1:
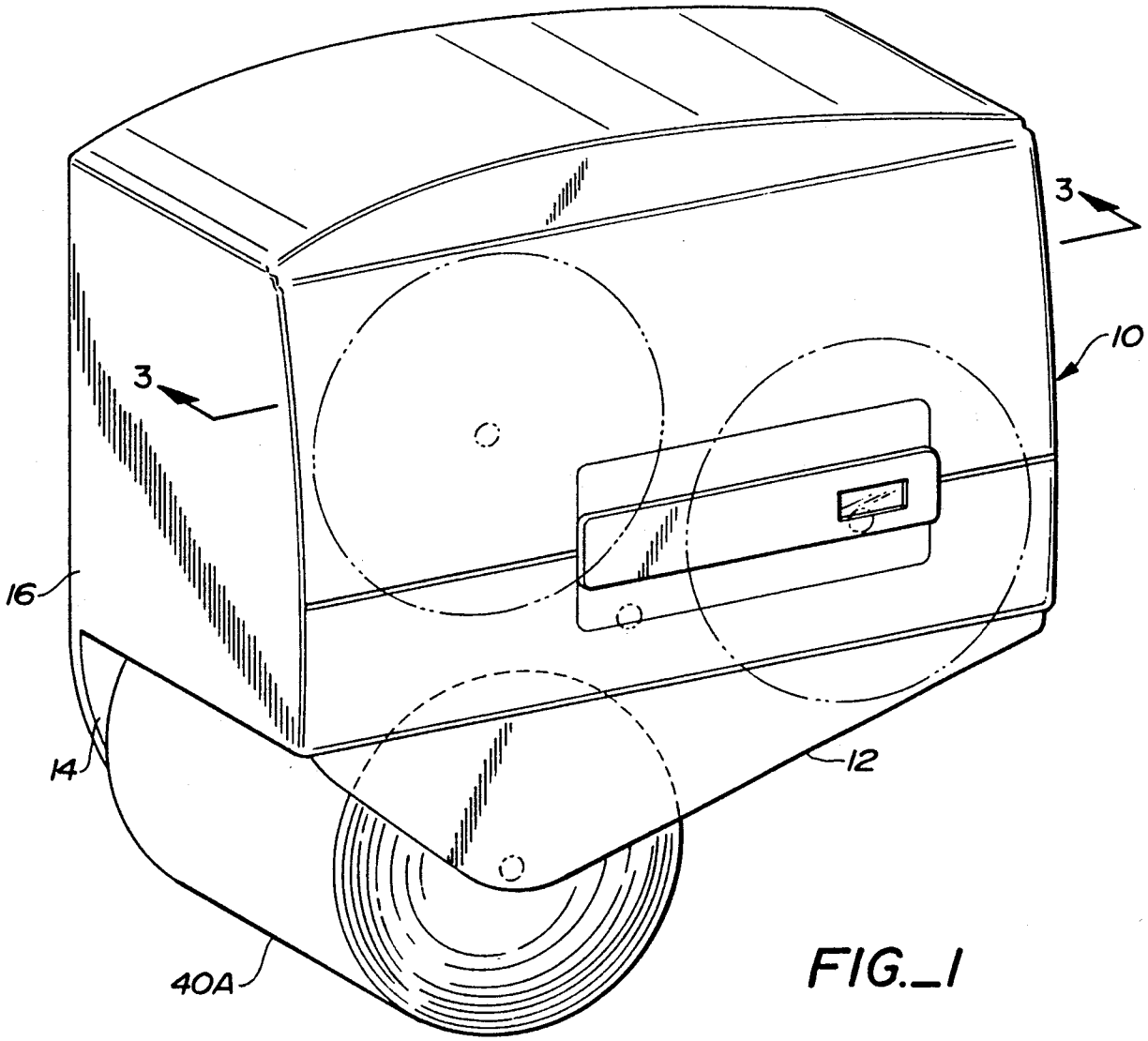
FIG. 1 is a frontal, perspective view of dispenser apparatus, including a closed housing, constructed in accordance with the teachings of the present invention.

Referring now to the drawings, the dispenser apparatus of the present invention has a support including a housing 10 having an opening 12 at the bottom thereof. In the arrangement illustrated, the housing 10 includes a back 14 and a front cover 16 hingedly connected thereto and movable between a closed position shown in FIG. 1 and an open position shown in FIG. 2.

Mounted on the back 14 and projecting therefrom is a spindle 18. Spindle 18 is disposed within a sleeve 20 comprising part of a roll holder 22. Sleeve 20 and the rest of the roll holder 22 are freely rotatably mounted relative to spindle 18. A bushing 24 is disposed between the sleeve 20 and spindle to maintain alignment therebetween so that the roll holder 20 will rotate about a fixed axis of rotation. As may perhaps best be seen with reference to FIG. 4, the distal end of the spindle 18 is received within a mounting element 26 located on front cover 16 to stabilize the spindle.

Roll holder 22 has three spaced arms 26. Projecting from the distal ends of the arms are support shafts 28. The three support shafts are spaced an equal distance from each other and the support shafts are also equidistant from the axis of rotation of the roll holder means as defined by spindle 18. Each support shaft includes an elongated shaft element 30 and a shaft sleeve 32 located at one end of the elongated shaft element adjacent to the arm 26 from which the elongated shaft element projects. If desired, the shaft sleeve and elongated shaft element may be of integral construction.

Figure 4:
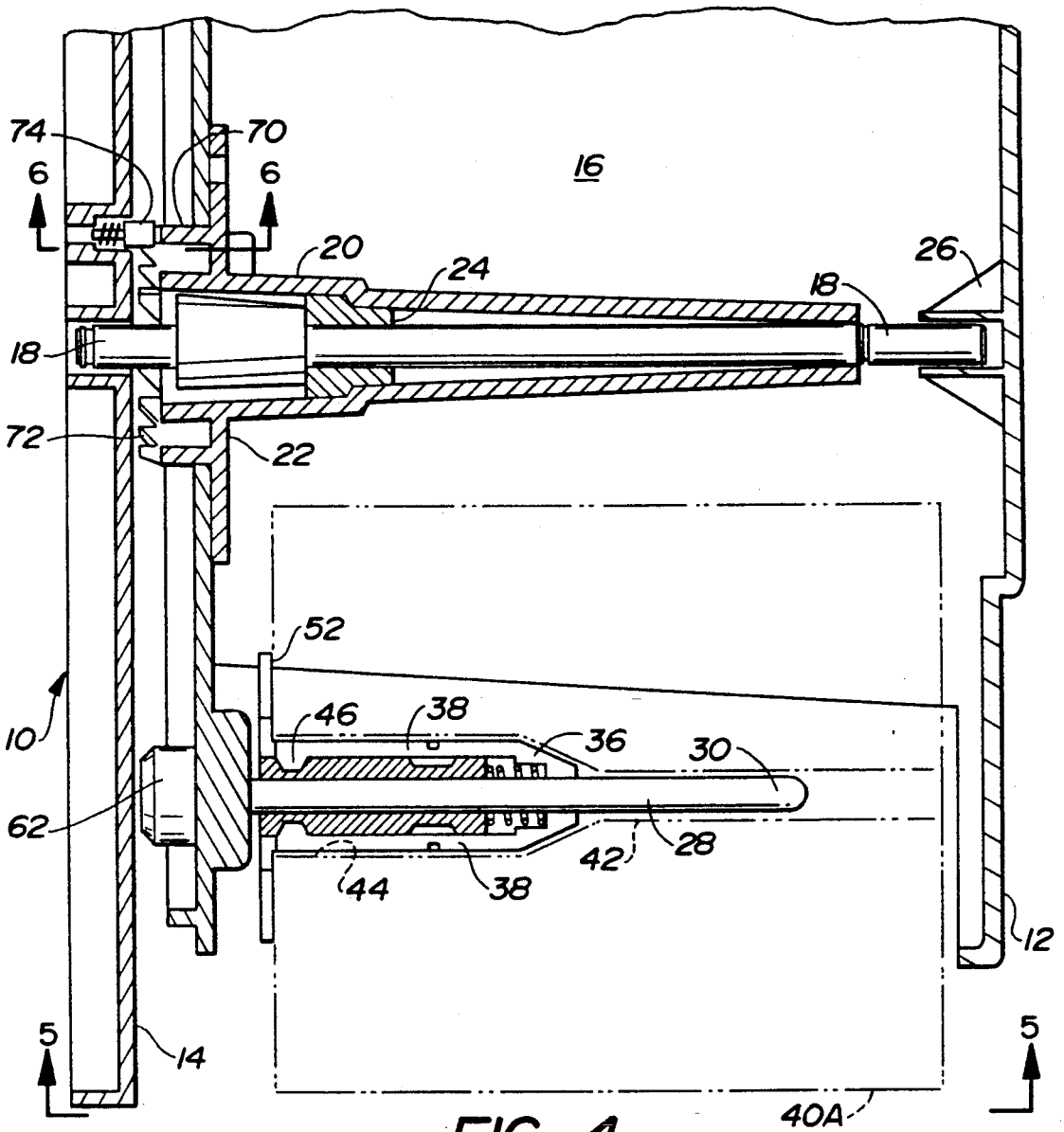
FIG. 4 is an enlarged, cross-sectional view taken along the line 4—4 in FIG. 3.

A lock sleeve 34 is axially slidably mounted on each support shaft and located over each shaft sleeve 32 and a portion of the support shaft immediately adjacent to the shaft sleeve. Lock sleeve 34 includes a lock sleeve body 36 and two opposed lock arms 38. The lock arms 38 are integral with the lock sleeve body but may be flexed relative thereto upon application of suitable force. With reference to FIG. 4, the lock arms 38 illustrated at the top of that figure are shown in the positions normally assumed thereby in the absence of outside forces being applied thereto. That is, the lock arms 38 diverge as they extend away from the lock sleeve body.

Upon application of opposed forces to the lock arms 38, the lock arms are movable to the relative positions illustrated at the bottom of FIG. 4. That is, the look arms 38 may be flexed relative to the lock sleeve body to bring the outer surfaces of the lock arms into general registry with the outer surface of the lock sleeve body. In the present arrangement, this movement is effected by sliding a coreless roll product such as toilet tissue roll 40 over the support shaft so that the support shaft extends completely through the roll.

It is to be noted that the roll has a central aperture 42 defined by the innermost convolution of the wound paper tissue. The aperture 42 has a smaller diameter than the diameter of lock sleeve body 36 of lock sleeve 34.

It will be appreciated that the act of initially positioning the roll 40 on the support shaft 28 will cause the roll to bear against the lock sleeve 34 and move the lock sleeve from the position shown at the top of FIG. 4 to the position shown at the bottom of FIG. 4. Continued insertion will result in depression of the lock arms 38 by the roll material defining the aperture. The lock arms 38 have inwardly directed protrusions 46 at the distal ends thereof which are received by a groove 48 formed about the periphery of shaft sleeve 32 when the lock arms are in the depressed condition shown at the bottom of FIG. 4. In effect, the lock arms are press fit into position because the lock sleeve diameter is greater than the diameter of the roll aperture. The shape of the aperture will generally conform to the shape of the lock sleeve where the lock sleeve and roll contact each other and the inner convolutions of the roll will be tightly wound about the lock arms 38, holding them in a lock position.

As noted above, lock sleeve 34 is axially movable relative to the support shaft. A coil spring 50 continuously urges the lock sleeve 34 to the position shown at the top of FIG. 4, however the force of a roll 40 being manually slid on the shaft is sufficient to overcome the force exerted by spring 50 and allow the lock sleeve to be pushed to the position shown at the bottom of FIG. 4.

In the arrangement illustrated, the lock sleeve body 36 includes a circular flange 52 which is abutted by the end of the roll and positively results in displacement of the lock sleeve body so that the protrusions 46 on lock arms 38 are in registry with groove 48 when the arms are biased inwardly by the inner convolution of the roll. The lock sleeve 34 and roll mounted thereon are free to rotate about the support shaft.

The flange 52 engages a lock element 54 which is pivotally mounted at an end thereof to an arm 26. When a roll 40 engages flange 52 and pushes the lock sleeve body inwardly toward the associated arm 26, the lock element 54 will be pivoted so that the distal end thereof moves toward its associated arm 26. This condition is shown at the bottom of FIG. 4.

Figure 2:
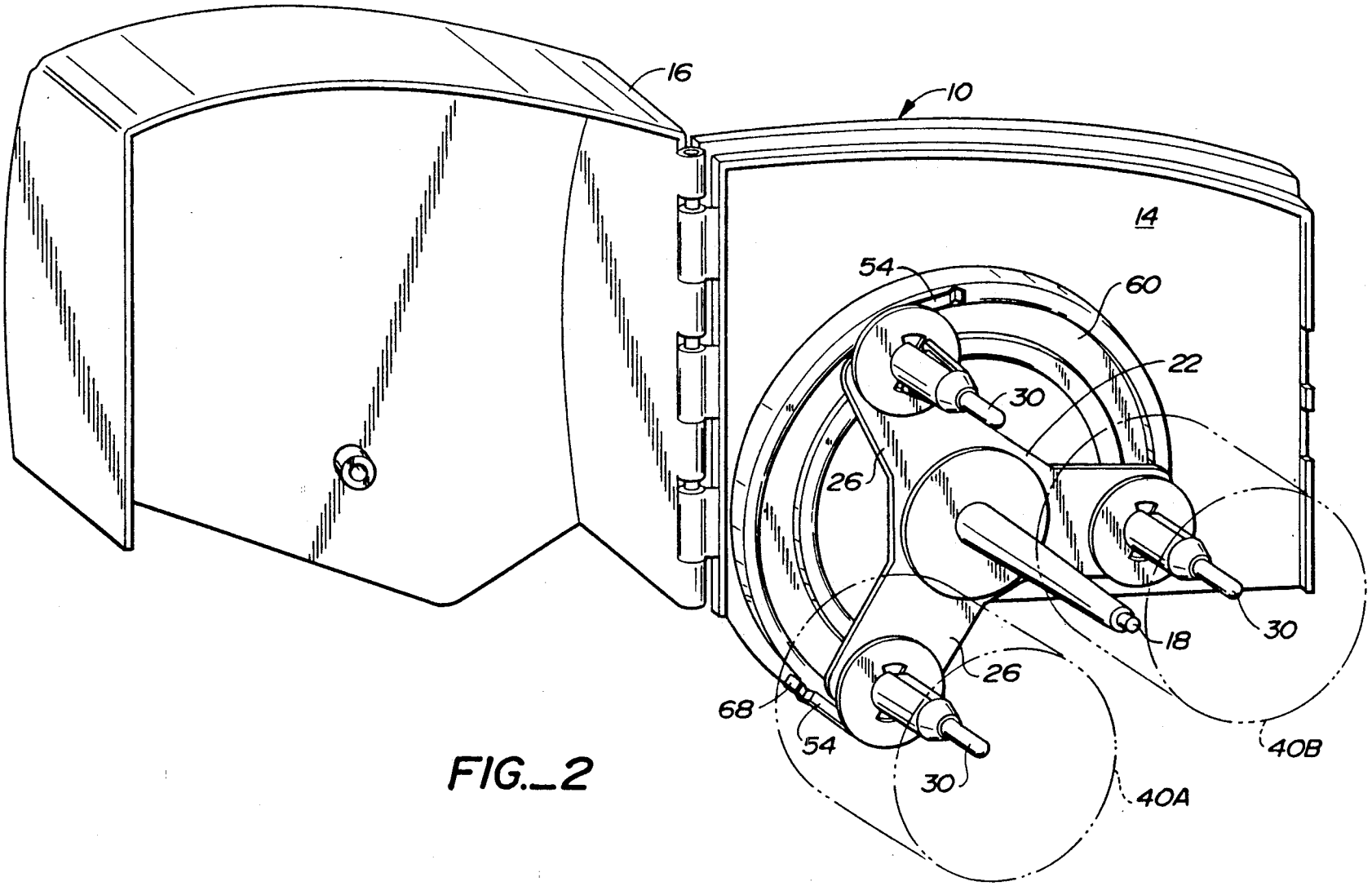
FIG. 2 is a frontal, perspective view of the dispenser apparatus with the housing open to show selected structural components of the invention.
Figure 3:
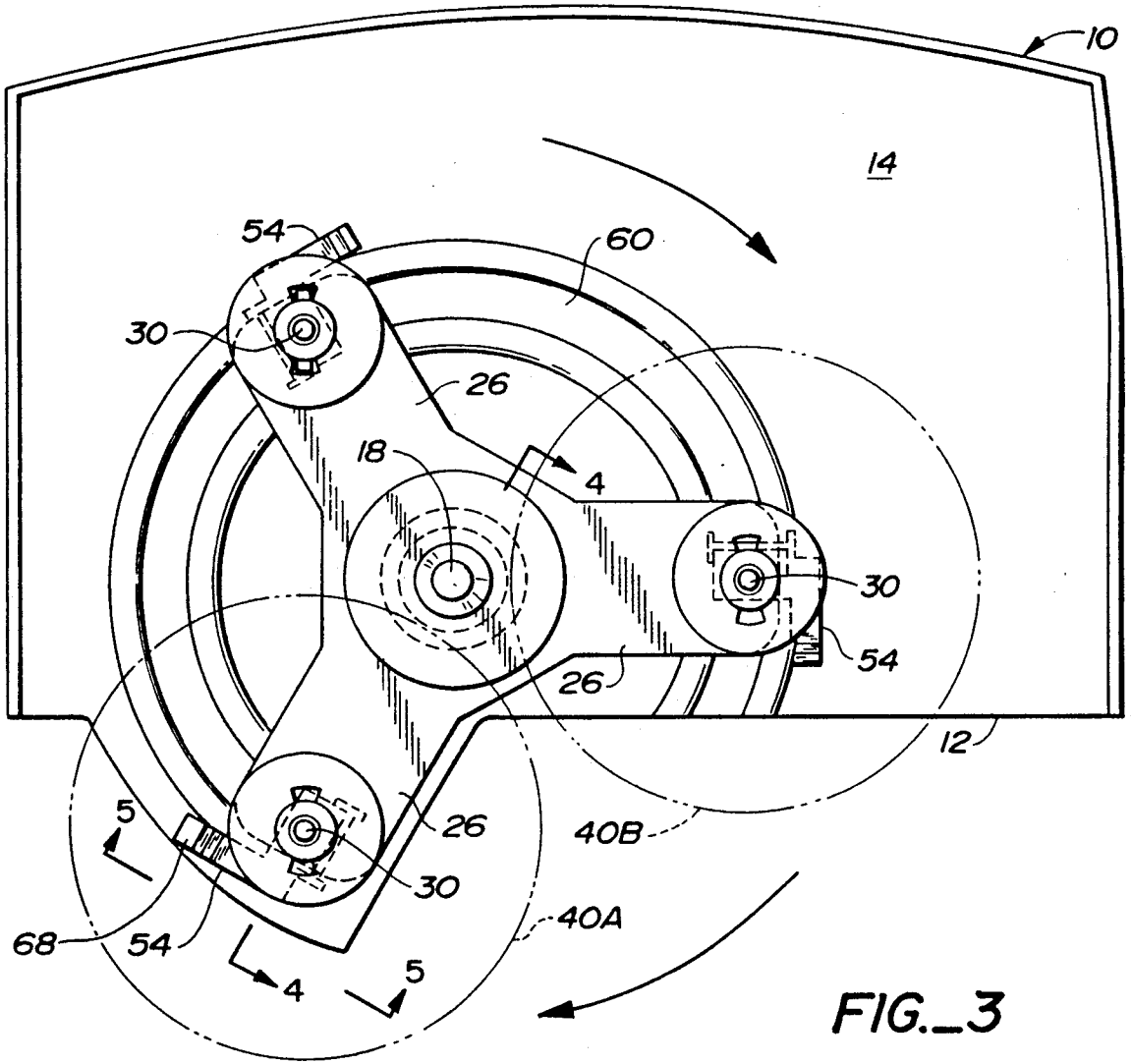
FIG. 3 is a frontal view of the apparatus roll holder means and associated housing structure.

Referring now to FIGS. 2 and 3, it will be noted the back 14 of the housing 10 forms a circular trackway or groove 60 surrounding spindle 18. The trackway 60 may be integrally molded along with the rest of the back 14. In any event, the trackway 60 is in the form of a circular segment accommodated bosses 62 located on arms 26 and projecting from the sides of the arms in opposition to support shafts 28. The circular trackway or groove 60 is open ended so that the bosses 62 may exit the trackway and re-enter same in an unimpeded fashion at the bottom of the housing back 14. That is, the circular trackway 60 terminates at opening 12 of the closed housing.

Arms 26 and the support shafts 28 thereon are radially disposed about spindle 18 and define a radial angle of 120 degrees therewith. With the arrangement illustrated, the roll holder 22, being freely rotatable about its axis of rotation in a clockwise manner as viewed in FIGS. 2 and 3, is rotatable about the axis of rotation thereof under the influence of gravity to bring rolls on the support shafts thereof seriatim to a predetermined dispensing position relative to the housing until all of the rolls on the roll holder are depleted.

In FIG. 2 a roll designated by reference numeral 40A is shown in the position it assumes at the opening of the housing for dispensing to a consumer, such dispensing being carried out in the conventional fashion by the consumer unwinding the roll. Roll 40A is locked into this position by locking means including lock element 54. An abutment member 68 projects into the housing interior from the back where the trackway communicates with the opening 12 at the left side of the dispenser as viewed in FIG. 2. As shown in FIG. 4, a lock element 54 operatively associated with a support shaft having a roll thereon will abut against abutment member 68 to halt clockwise movement of the roll holder and rolls disposed thereon. The geometry of the roll holder is such that it will be continuously urged in such clockwise direction as long as a roll remains thereon. That is, the roll holder and any rolls thereon are in an unbalanced condition which will cause rotation of the roll holder to present a roll at the dispensing location at the opening of the cabinet whether the roll holder holds one, two, or three rolls.

Once the roll located at the opening is depleted, lock arms 38 are free to move outwardly. Lock sleeve 34 is pushed away from its associated arm 26 by coil spring 50 to withdraw protrusions 46 from groove 48 of shaft sleeve 32. The lock element 54 is then free to pivot outwardly and clear the abutment member 68. The unbalanced load will cause the roll holder 22 to rotate and the next roll (roll 40B in FIG. 2) to advance to dispensing position, the lock element 54 operatively associated with roll 40B abutting abutment member 68.

Figure 6:
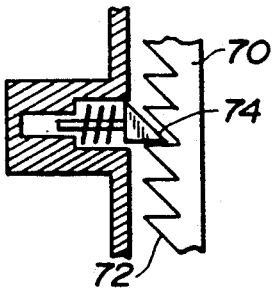
FIG. 6 is a diagrammatic view of that portion of the apparatus denoted by line 6—6 in FIG. 4 illustrating selected operational components of the device in one condition of operation.
Figure 6A:
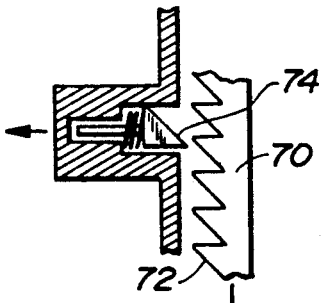
FIG. 6A is a view similar to FIG. 6 but illustrating the operational components in another condition of operation.
Figure 5:
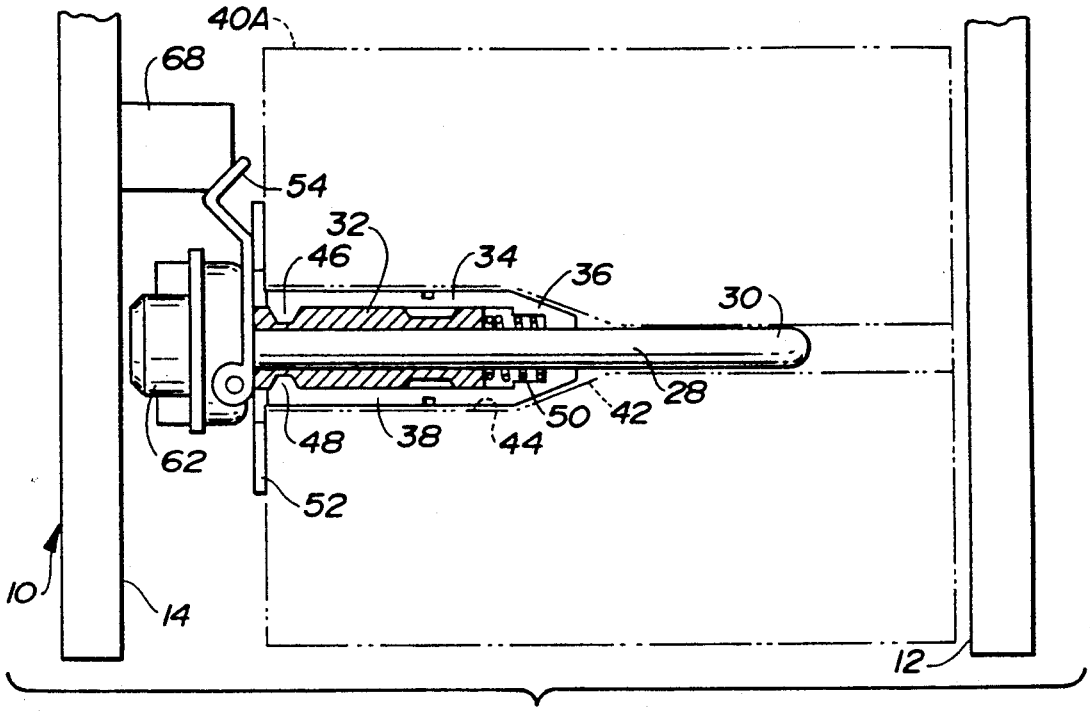
FIG. 5 is a bottom view of a portion of the apparatus as taken along 5—5 in FIG. 4.
Figure 5A:
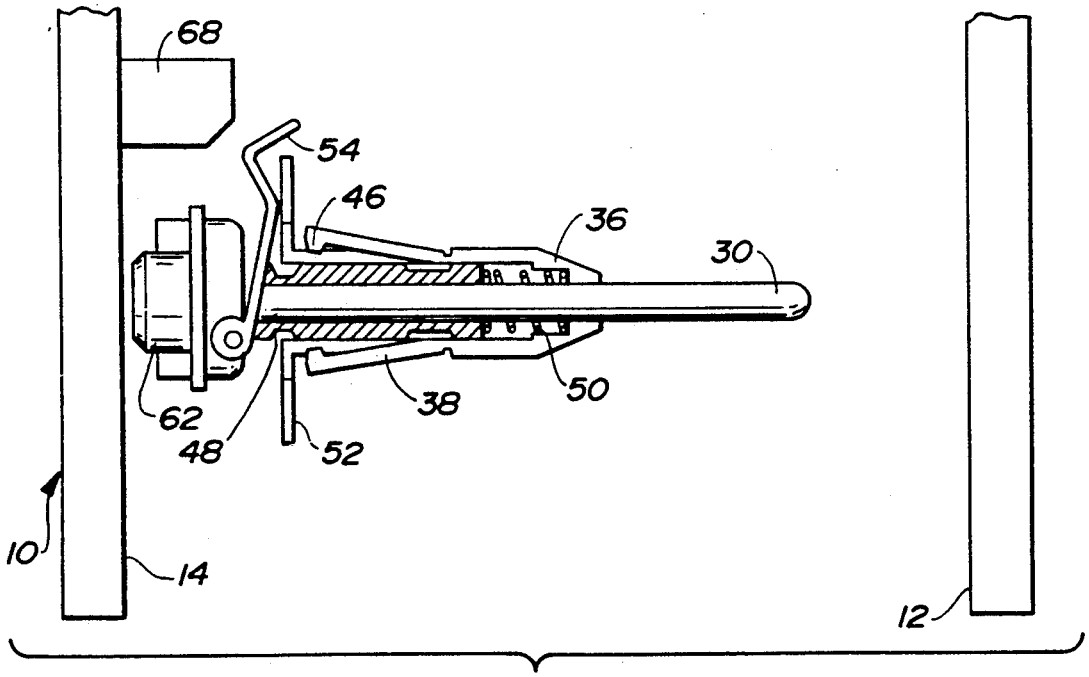
FIG. 5A is a view similar to FIG. 5 but showing the relative positions assumed by structural components of the apparatus after depletion of a roll.

The apparatus of the present invention is so constructed as to positively prevent the roll holder 22 from rotating in a counter clockwise direction, as viewed in FIG. 2. As may be seen in FIGS. 4, 6 and 6A, roll holder 22 includes a circular wall 70 having teeth 72 thereon projecting toward the back of the cabinet or housing. The circular wall 70 is in engagement with a spring biased lock element 74 which successively enters between the teeth 72 and will allow rotation of the circular wall 70 and thus the entire roll holder 22 in only one direction, that is, the clockwise direction as viewed in FIGS. 2 and 3.

We claim:

1. Apparatus for sequentially dispensing web material from a plurality of rolls of said web material, said apparatus comprising, in combination:

a support including a housing having an opening;

roll holder means movably mounted on said support for rotation about an axis of rotation, said roll holder means including at least three spaced roll support shafts, each support shaft for insertion into a roll for supporting a roll, rotation of said roll holder means sequentially presenting said support shafts at said opening and rotation of said roll holder means being interrupted when a support shaft holding a roll is presented at said opening until the roll held thereby is depleted, said roll holder means rotating in response to depletion of a roll on a shaft at said opening to present another support shaft holding a roll at said opening, said support shafts being so positioned relative to each other and relative to said axis of rotation as to create an unbalanced condition of the roll holder means and rolls on said support shafts and exert a biasing force on the roll holder means causing rotation of said roll holder means under the influence of gravity until all rolls on said support shafts are depleted; and lock means operatively associated with said support and said roll holder means for locking said roll holder means against further rotation about said axis of rotation after interruption of roll holder means rotation, said lock means being responsive to depletion of a roll at the opening to unlock said roll holder means and allow said roll holder means to rotate under the influence of gravity, said locking means including a lock element operatively associated with each of said shafts and movable relative thereto between a first position wherein said lock element engages said support and locks said roll holder means against rotation about the axis of rotation and a second position wherein the lock element is disengaged from said support and permits rotation of said roll holder means, each said support shaft including a support shaft member engageable with a respective lock element, said support shaft member movable between a first location wherein said support shaft member maintains said lock element in said first position and a second location wherein said lock element is movable to said second position, biasing means biasing said support shaft member toward said second location, said support shaft member engageable with a roll when in said first location, said roll blocking movement of said support shaft member to said second location by said biasing means until the engaged roll is depleted.

2. The apparatus according to claim 1 wherein said lock elements lock said roll holder means against rotation in a predetermined rotational direction, and said lock means additionally comprising ratchet means operatively associated with said roll holder means and said support for locking said roll holder means against rotation in a rotational direction opposite of said predetermined rotational direction.

3. The apparatus according to claim 2 wherein each lock element is mounted for pivotal movement.

4. The apparatus according to claim 1 wherein said web material is paper and said rolls are coreless rolls of paper tissue having respective central apertures defined by a convolution of said paper tissue, each said support shaft being positionable in a central aperture of one of said coreless rolls.

* * * * *